US006800035B1

(12) United States Patent
Couch

(10) Patent No.: US 6,800,035 B1
(45) Date of Patent: Oct. 5, 2004

(54) GOLF CLUB SWING TRAINER

(76) Inventor: John M. Couch, 1221 SW. Englewood Dr., Portland, OR (US) 97034

( * ) Notice: Subject to any disclaimer, the term of this patent is extended or adjusted under 35 U.S.C. 154(b) by 0 days.

(21) Appl. No.: 10/465,263

(22) Filed: Jun. 18, 2003

(51) Int. Cl.[7] ..... A63B 69/36
(52) U.S. Cl. ..... 473/213
(58) Field of Search ..... 473/207, 212, 473/213, 219, 227, 266, 267, 276

(56) References Cited

U.S. PATENT DOCUMENTS 2,191,683 A * 2/1940 Thomas ..... 473/211
3,025,064 A * 3/1962 Flood ..... 473/211
3,063,721 A * 11/1962 Jackson ..... 473/211
3,156,211 A * 11/1964 Mallory, Jr. ..... 473/211
3,368,817 A * 2/1968 Duncan ..... 473/215
3,528,664 A * 9/1970 Gunn ..... 473/213
3,811,684 A * 5/1974 Tredway, Sr. ..... 473/212
3,860,245 A 1/1975 Yamada
5,005,835 A * 4/1991 Huffman ..... 473/209
5,152,532 A * 10/1992 Rouse ..... 473/213
5,423,547 A 6/1995 Puso
5,509,809 A * 4/1996 Clay ..... 434/252
5,728,014 A * 3/1998 Prunckle ..... 473/422
5,771,492 A * 6/1998 Cozza ..... 2/161.2
5,984,796 A * 11/1999 Mah ..... 473/215

* cited by examiner

*Primary Examiner*—Gregory Vidovich
*Assistant Examiner*—Nini F. Legesse
(74) *Attorney, Agent, or Firm*—Olson & Olson

(57) ABSTRACT

A metal ball is contained in a tubular container having one end of sound deadening material and the opposite end of a material that produces a sound when struck by the ball falling through the tube from the opposite end. The container is arranged for mounting preferably on the leading hand of a practicing golfer, such that the ball impacts the sound-producing end of the tube when the leading hand reaches the desired position at the top of the backswing segment and there pauses for a second or so, and at the desired position of the end of the follow-through segment. The mounting of the container is on a golfer's leading hand glove, wrist band, or other supporting device, with the sound producing end of the container facing the fingers of the practicing golfer.

4 Claims, 2 Drawing Sheets

GOLF CLUB SWING TRAINER

BACKGROUND OF THE INVENTION

This Invention relates to the sport of golfing, and more particularly to a golf club swing trainer for use by practicing golfers for perfecting and replicating the attainment of the proper end positions of the top of the backswing and the top of the follow-through.

Timing of the end position of the top of the backswing segment of a golf club swing is the most difficult aspect of the game to consistently repeat properly because during the swing it is nearly impossible for the player to measure both his overall tempo and whether or not he makes the important pause at the top. Both are vital for distance and accuracy.

The only known prior device alleged to be capable of providing the identification of the end positions of a golf club swing, is disclosed in U.S. Pat. No. 5,423,547 which discloses a battery operated arm position monitoring device attachable to the wrist of a practicing golfer and operable to emit an audible electric signal to alert a practicing golfer when the preset positions of a golf club swing are reached. The device is adjustable to accommodate different swing positions of a plurality of golfers. Accordingly, the device is usable only by the person for which it is adjusted. Its primary emphasis is on position instead of the all-important timing pause at the top of the backswing that must occur before starting the downswing.

U.S. Pat. No. 3,860,245 discloses a device for adjusting the backswing arm positions of a golf player, in which a ball is supported for rolling movement along a guide channel which rotates with movement of the arms and hands of a golfer in the backswing portion of a golf club swing to impact a sound producing surface. The guide channel is adjusted for each player's top end position of the backswing, and again its emphasis is position instead of timing. Position is important, however, but timing is equally important to maximize club head speed at impact, for distance and accuracy.

SUMMARY OF THE INVENTION

The golf club swing trainer of this invention includes a container in which a ball may roll or drop freely between one end having a sound deadening material for muffling any sound when impacted by the ball and an opposite end of a material that makes an audible "click" sound when impacted by the ball dropping onto it. The container is mounted by Velcro on a golf glove or other support for attachment to a hand, preferably the leading hand of a practicing golfer, in such position that when a golf club is swung to a desired top end of the backswing segment of a golf club swing and pauses there for a second or so, and subsequently to the desired end of the follow-through segment after properly turning the body and pauses there for a short period of time, as above, the ball makes audible impact with the end of the container opposite the sound deadening material. Positions between the back swing and follow-through end segments of the swing move the ball into impact with the sound deadening material. In this manner, an audible signal is given to the practicing golfer only if the important pause occurs at the top of the backswing. A second signal is heard by the opposite ear of the practicing golfer if the body turn and follow-through is high and sufficiently complete so that the ball will roll to the end of the tube to produce a "click".

The principal objective of this invention is the provision of a golf club swing trainer that provides audible signals to the practicing golfer identifying the end positions of the backswing and follow-through segments of a golf club swing selected as desirable for the practicing golfer, to enable the golfer to recognize consistently when there is a proper pause at the top of the backswing.

A further objective of this invention is the provision of a golf club-swing trainer of the class described that is light in weight, portably mountable on a hand of the practicing golfer, and facilitates, through repetition, developing muscle memory of the proper golf club swing.

Another objective of this invention is to provide a golf club swing trainer of the class described in which a ball-containing cylinder may be mounted removably on a hand, preferably the leading hand of a practicing golfer, to provide an audible signal when the golf club swing reaches the terminal ends of the backswing and follow-through segments of the swing of the practicing golfer.

Still another objective of this invention is the provision of a golf club swing trainer of the class described in which a ball-containing cylinder is mountable removably on the selected hand of a practicing golfer by any of a wide variety of attaching devices, such as the Velcro closure of a conventional golf glove, or a wrist band.

A further objective of this invention is to provide a consistently effective golf club swing trainer of the class described that requires no maintenance or adjustments for any practicing golfer.

Still another objective of this invention is the provision of a golf club swing trainer of the class described that is of simplified construction for economical manufacture and consistent precision of performance for all practicing golfers.

The foregoing and other objects and advantages of this invention will appear from the following detailed description, taken in connection with the accompanying drawings of a preferred embodiment.

DESCRIPTION OF THE PREFERRED EMBODIMENT

Figure 1:
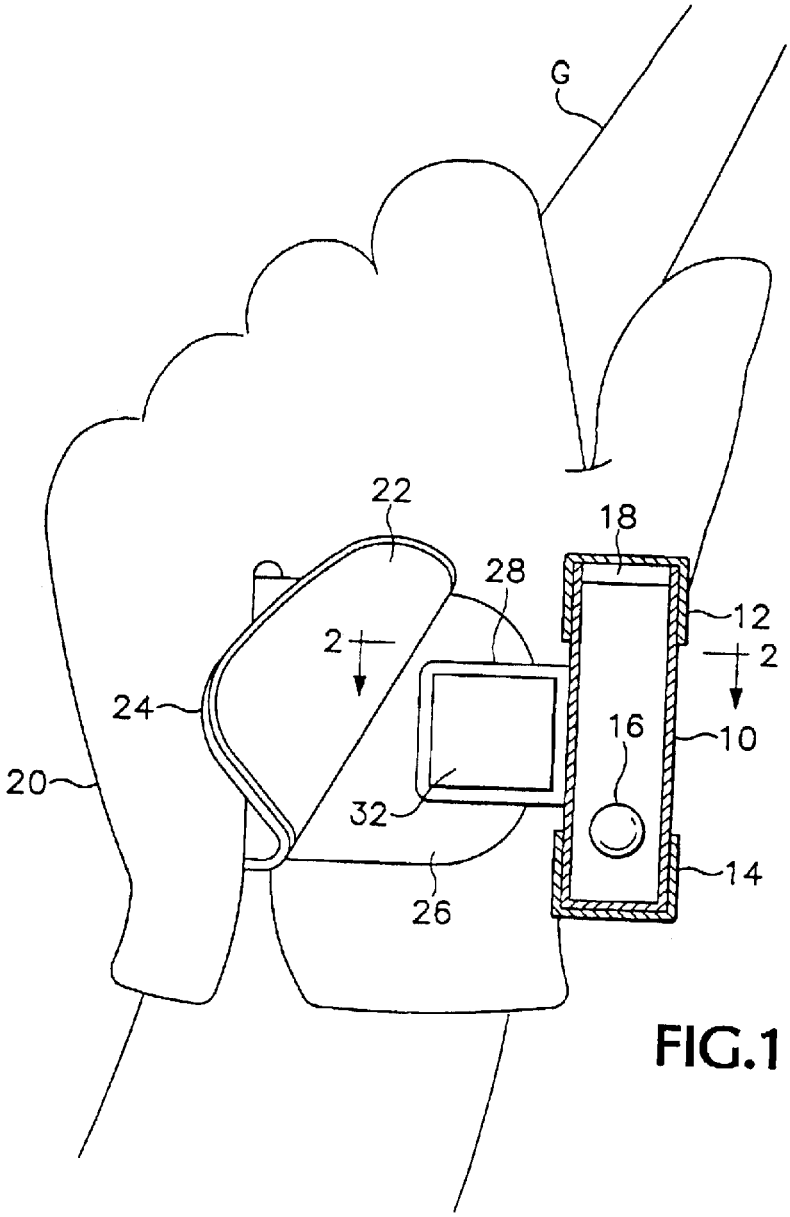
FIG. 1 is a longitudinal sectional view of a golf club swing trainer embodying the features of this Invention supported on the left hand glove of a practicing golfer.
Figure 2:
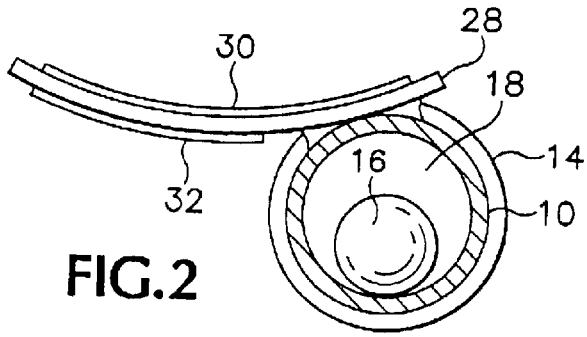
FIG. 2 is a cross sectional view taken on the line 2—2 in FIG. 1.

Referring particularly to FIGS. 1 and 2 of the drawings, the illustrated golf club swing trainer includes a hollow tube 10, closed by end caps 12 and 14, and containing a ball 16 or similar object configured to move by gravity freely between the ends of the tube. Adjacent one end of the tube, the end at end cap 12 in the illustration, is located a block or other form of mass 18 of sound deadening material secured or otherwise contained within the tube. The mass 18 serves to muffle any sound when impacted by the ball 16 when dropped through the tube.

The end cap 14 at the end of the tube opposite the mass 18 confines a tube end made of a material that makes an audible sound when impacted by the ball 16. Thus, when the tube is moved to a position which allows the ball to roll or drop by gravity and impact the mass 18, no audible signal is made. However, when the tube is moved to a position which allows the ball to roll or drop by gravity into impact with the tube end at the cap 14, an audible sound is clearly heard by the practicing golfer.

It will be understood that the end cap 14 may be replaced with an end wall integrated into the tube during manufacture.

Figure 3:
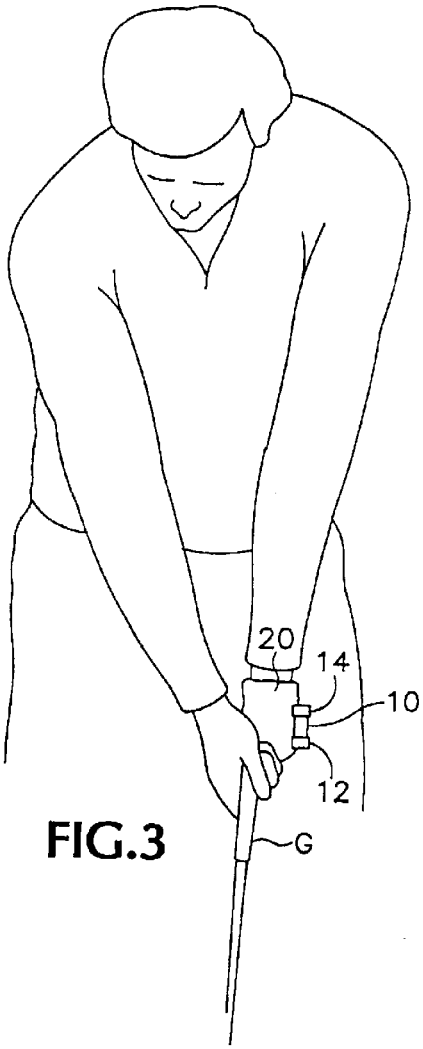
FIG. 3 is a fragmentary perspective view of a practicing golfer having mounted on the left hand golf glove of a right handed golfer a golf club swing trainer of this invention at the address position of a golf club swing.
Figure 4:
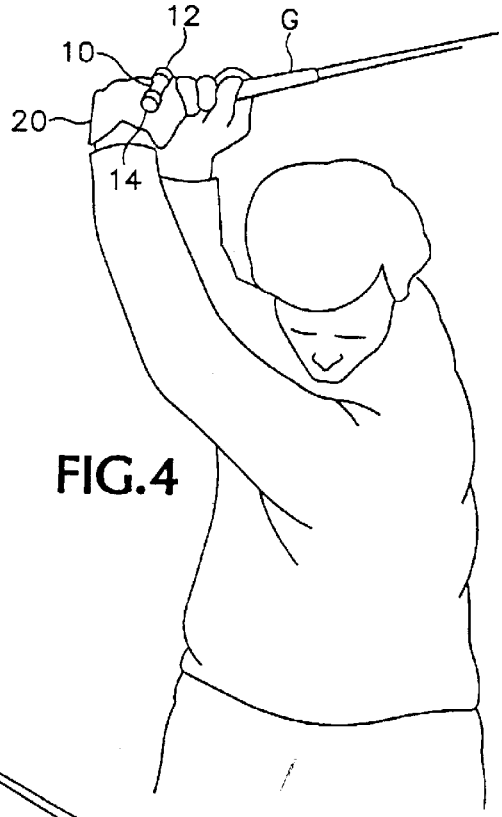
FIG. 4 is a fragmentary perspective view, similar to FIG. 3, with the practicing golfer being shown at the desired end position of the backswing segment of a golf club swing characteristic of the practicing golfer.
Figure 5:
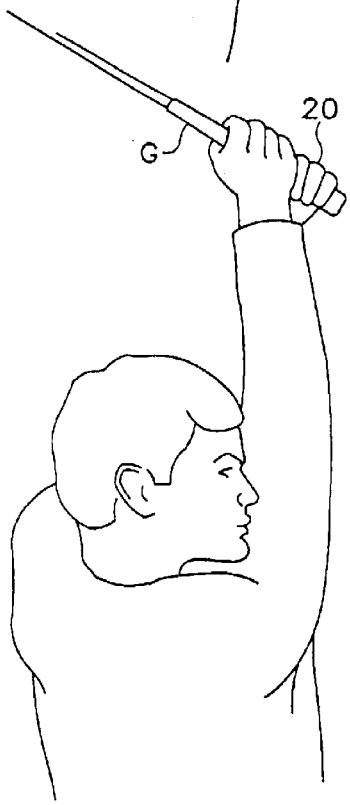
FIG. 5 is a fragmentary perspective view, similar to FIGS. 3 and 4, with the practicing golfer being shown at the desired end position of the follow-through segment of the golf club swing characteristic of the practicing golfer.

Referring now to FIGS. 3, 4 and 5 of the drawings, FIG. 3 shows the position of the hands and golf club grip G at the address position of a practicing golfer just prior to the start of the backswing. Means is provided for securing the swing trainer device to a hand of a practicing golfer. As illustrated in FIG. 3, the swing trainer device is mounted on the left hand of a right handed golfer. If the golfer is left handed, then the device preferably is mounted on the right hand. Thus, the device preferably is mounted on the leading hand of a practicing golfer.

In the embodiment illustrated in FIG. 1, the device is secured removably to a conventional left hand golf glove 20. As Illustrated, the glove is provided with a hook and loop closure of the Velcro type. The loop component 22 is secured to the closure tab 24 of the golf club and the hook component 26 is secured to the backside of the glove. The tube 10 is secured removably between the backside of the glove and the closure tab 24 with the end cap 12 facing toward the fingers of the glove.

In the embodiment illustrated (FIG. 2), a small piece of aluminum or other firm base sheet material 28 is secured at one end to a central portion of the tube 10 (FIG. 1), as by welding, solder, adhesive, etc., and extends laterally of the tube, toward the left in the illustration. The base sheet material 28 preferably is curved to conform to the curvature of the backside of the hand of the practicing golfer. A small piece of loop component 30, as of Velcro, is secured to the surface of the base sheet material 28 facing away from the tube 10 and a small piece of the hook component 32 is secured to the opposite side surface of the base sheet material. Thus, the loop component 30 may be secured to the hook component 26 on the golf glove 20 (FIG. 1) to secure the tube 10 to the glove 20. The closure tab 24 with loop component 22 is folded over the hook component 32 on the base sheet material 28. Thus, the tube 10 is secured positively between the closure tab 24 and backside of the glove, with the cap 12 facing toward the fingers.

In the address position of FIG. 3, the left band grips a golf club grip G adjacent the butt end thereof, with the thumb extending down the grip. The end cap 12 thereby faces downward and the ball 16 rests upon the sound deadening mass 18.

FIG. 4 shows the position of the hands and golf club at the top of the backswing desired by the practicing golfer. In this position the arms and hands have moved upward from the address position of FIG. 3 and are located adjacent the right side of the player's head. The tube 10 has rotated with the hand so that the end cap 14 faces downward. If this position is maintained for the important slight pause, of a second or so, before the downswing is commenced, the ball 16 will have rolled or dropped by gravity into impact with the end of tube 10 at cap 14. Since the hands are closely adjacent the right ear of the practicing golfer, the audible sound of impact is clearly heard by the golfer, announcing the proper completion of the desired backswing segment of the golf club swing characteristic of the practicing golfer.

If the practice swing is too fast or the downswing is started before finishing the backswing, or the backswing is so flat or the wrist is not properly cocked, so that the tube 10 is not inclined sufficiently to afford gravity movement of the ball 16, the ball does not impact the sound-producing end 14 of the tube.

After a number of practice backswings which terminate and pause at the desired top end position, muscle memory establishes the desired top end timing position that is repeatable with consistency, announced by the audible signal of ball 16 striking tube end 14. This procedure also may be employed for replicating the desired follow-through end position.

As the practicing golfer moves into the downswing segment of the golf club swing, the hands and golf club begin to return toward the address position of FIG. 3. However, this movement differs from that of the backswing movement in that the club head now accelerates to maximum speed at the address position of FIG. 1, which now is the impact position of contact with a golf ball at the accelerated, maximum club head speed of the golf club. This acceleration of the golf club and hands results in movement of the ball 16, by centrifugal force, into impact with the sound deadening mass 18. Accordingly, no sound is emitted from the trainer device during the accelerated downswing segment of the golf club swing.

FIG. 5 shows the positions of the hands and golf club at the proper high finish of the follow-through segment of the golf club swing characteristic of the practicing golfer. In this position the golfer's hands are located adjacent the left side of the head and the trainer tube 10 has been rotated to the same cocked position as at the top of the backswing, with end cap 14 facing downward as in FIG. 4. The ball 16 then will have rolled or dropped by gravity from the mass 18 into impact with the tube end at cap 14. The audible sound, now clearly heard as a "click" at the left ear of the practicing golfer, announces the attainment of the proper finish position of the follow-through, characteristic of the practicing golfer.

It is to be understood that the golf club swing trainer of this invention may be used primarily to detect only the desired position of the top of the backswing segment, since it is that position that determines the maximum speed and proper alignment position of a golf club head upon impact with a golf ball at the end of the downswing segment of the golf club swing. It is also to be understood that, as illustrated in FIGS. 3, 4 and 5, the sloping position of the leading hand on which the golf club supported swing trainer is mounted, is substantially matched by the other hand of the practicing golfer. Accordingly, the golf swing trainer may be mounted on the trailing hand as well, although it is preferred that the mounting be on the leading hand.

Further, it will be apparent to those skilled in the art that various changes and modifications may be made in the size, shape, type, number and arrangement of parts described hereinbefore. For example, the diameter of the tube 10 and ball 16 may be varied as desired, and the materials of which the tube and/or ball are made may be chosen from a wide variety, such as steel, aluminum and many others, that are capable of providing a suitable audible sound. The mass 18 may be of any sound deadening material, such as a block of cork, a mass of cotton, or any other substance having the desired sound deadening quality for the purpose. The metal tube may have an internal lining of rubber or other sound deadening material to further deaden the sound of the ball moving from one end to the other. Alternatively, the tube may be made of synthetic resin with one end closed by a metal disc to provide the sound of impact by the ball. The tube may be secured removably to the hand of a practicing golfer by various means other than a golf glove. A simple strap, such as a watch band, may be secured to the tube 10 and mounted at the wrist of the practicing golfer. These and other changes may be made as desired, without departing from the spirit of this invention and the scope of the appended claims.

I claim:

1. A golf club swing trainer, comprising:

a) mechanical means for producing an audible signal when moved from a second position to a first position and for inhibiting production of an audible signal when moved from said first position to said second position, and b) means for mounting said signal producing means on an arm of a practicing golfer in a position for moving said signal producing means between said second position at the address position of a golf club held by a practicing golfer and said first position at the desired limit of the backswing position of the golf club held by the practicing golfer, whereby the produced audible signal announces the attainment of the desired backswing portion of a golf club swing.

2. The golf club swing trainer of claim 1 wherein the means for producing an audible signal comprises a container having a first end of sound signal producing material and a second end of sound deadening material, and a ball in the container movable freely between said first and second ends and capable of producing an audible sound when contacting said container first end, and means on the container configured for mounting on a hand of a practicing golfer with the second end of the container facing the fingers of the golfer's hand.

3. The golf club swing trainer of claim 2 wherein the mounting means comprises a golf glove.

4. The golf club swing trainer of claim 1 wherein the means for producing an audible signal comprises a metal container having a first end of sound signal producing material and a second end of sound deadening material, a metal ball in the container movable freely between said first and second ends, a golf glove configured for mounting on a hand of the practicing golfer, and attaching means on the container and the golf glove for securing the container to the golf glove with the sound deadening end of the container facing the finger tip ends of the glove.

* * * * *